United States Patent [19]

Holland-Letz et al.

[11] 4,387,645

[45] Jun. 14, 1983

[54] PRINTING MECHANISM

[75] Inventors: Günter Holland-Letz, Hirschhorn; Klaus Dasting, Neckarsteinach, both of Fed. Rep. of Germany

[73] Assignee: Esselte Pendaflex Corporation, Garden City, N.Y.

[21] Appl. No.: 239,802

[22] Filed: Mar. 2, 1981

[30] Foreign Application Priority Data

Mar. 4, 1980 [DE] Fed. Rep. of Germany ..... 3008165
Jun. 30, 1980 [DE] Fed. Rep. of Germany ..... 3024800

[51] Int. Cl.[3] ..... B41F 31/32

[52] U.S. Cl. ..... 101/327; 101/305; 101/314; 101/326; 101/360; 101/66

[58] Field of Search ..... 101/66, 69, 288, 287, 101/291, 327–331, 348, 324, 325, 326, 301, 305, 310, 314, 359, 360, 363; 156/363, 384

[56] References Cited

U.S. PATENT DOCUMENTS

| | | | |
|---|---|---|---|
| 1,724,074 | 8/1929 | DuBelle | 101/327 X |
| 4,044,677 | 8/1977 | Hamisch, Jr. | 101/348 |
| 4,068,584 | 1/1978 | Sato | 101/288 X |
| 4,075,944 | 2/1978 | Conley | 101/288 X |
| 4,113,544 | 9/1978 | Sato | 101/288 X |
| 4,178,849 | 12/1979 | Sato | 101/288 X |
| 4,213,389 | 7/1980 | Sato | 101/288 X |
| 4,273,046 | 6/1981 | Sato | 101/348 |

FOREIGN PATENT DOCUMENTS 2639927 5/1979 Fed. Rep. of Germany .

*Primary Examiner*—Edgar S. Burr
*Assistant Examiner*—Moshe I. Cohen
*Attorney, Agent, or Firm*—Jordan and Hamburg

[57] ABSTRACT

The invention relates to a printing mechanism, particularly for labelling devices, with an adjustable printing attachment, an inking rocker arm 20 and 108 which can be swung out and is swung out of its movement path on moving the printing attachment and a transfer roller 2, which inks the set type of the printing attachment said transfer roller 2 cooperating with a supply roller 4 arranged on a roller holder 6 and 106 freely rotatable about a spindle parallel to the transfer roller spindle 16. The roller holder 6 is pivotably mounted about the spindle 16 of transfer roller 2 and has laterally outwardly projecting projections 12, which engage on the guide rails 8 arranged on the sidewalls 18 of the casing. According to another preferred embodiment the roller holder 106 is pivotably mounted on the inking rocker arm 108, the transfer roller 2 is arranged in freely rotatable manner on roller holder 106 and the roller holder 106 has laterally outwardly projecting projections 114 engaging on inwardly projecting projections 128 arranged on the inking rocker arm 108.

19 Claims, 11 Drawing Figures

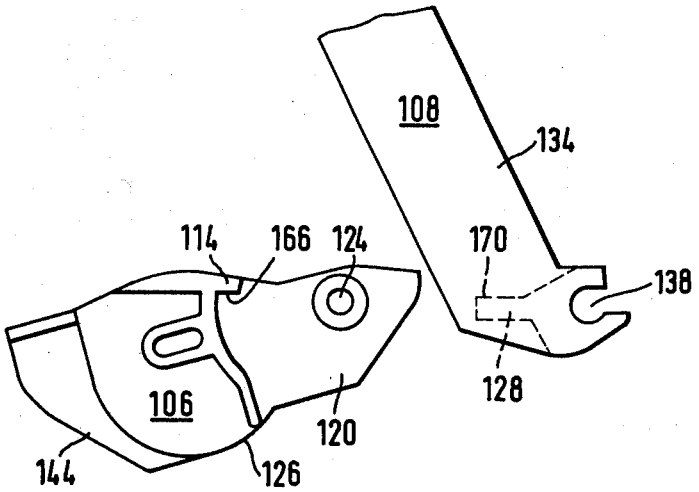
FIG. 8
FIG. 9
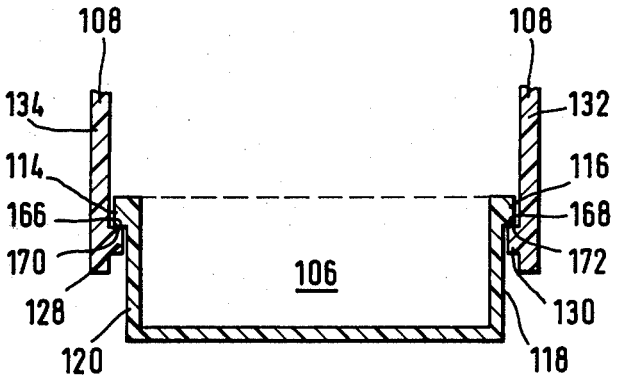

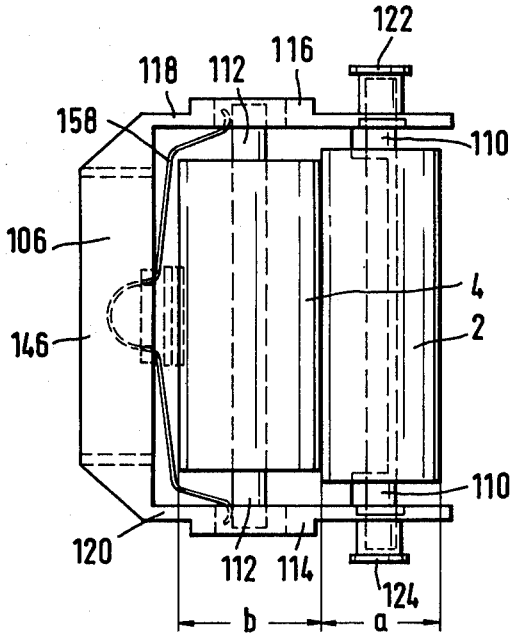
FIG. 10
FIG. 11
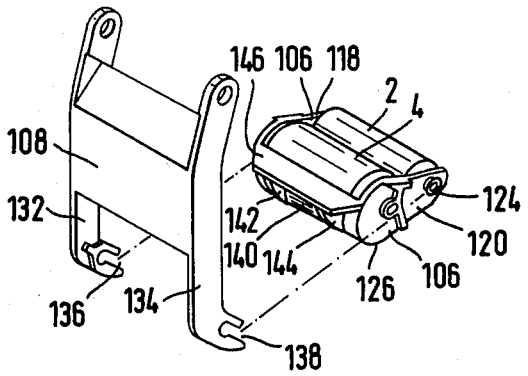

PRINTING MECHANISM

BACKGROUND OF THE INVENTION

The invention relates to a printing mechanism, particularly for labelling devices, with an adjustable printing attachment, an inking rocker arm which can be swung out and is swung out of its movement path on moving the printing attachment and a transfer roller which inks the set type of the printing attachment and cooperates with a supply roller arranged on a roller holder freely rotatable about a spindle parallel to the transfer roller spindle.

Such a printing mechanism is known from Federal Republic of Germany Auslegeschrift (DE-AS) No. 26 39 927 and has a return spring holding the inking rocker arm in the inking position and a roller holder mounted on the inking rocker arm. This known printing mechanism has the disadvantage that during the printing process the roller holder projects forward beyond the leading edge of the apparatus. When printing labels it is desirable that no part of the printing mechanism projects beyond the leading edge of the casing, so that the labelling device can also be used close to walls.

In addition, an inking mechanism with a transfer roller and an inking roller for a hand stamp is known from British Pat. No. 322 263. In this known inking mechanism the transfer roller is placed on a roller holder mounted on the inking rocker arm and is pivotable about a spindle parallel to the rocker arm spindle and is pressurised by a pressure spring bearing against the rocker arm.

In the known hand stamp the inking rocker arm is pivotably mounted on the printing attachment and its swivel pin performs the printing attachment travel and for this purpose is guided in a longitudinal guide. Furthermore the inking rocker arm is connected by means of a cam to the hand stamp frame, so that the movement of the rocker arm is forcibly mechanically coupled with the movement of the printing attachment.

The rollers, i.e. the transfer roller and the inking roller are also mechanically coupled. On raising the printing attachment these rollers are further rotated by means of a driving arm.

Due to this mechanical coupling mechanism the known hand stamp is costly and fault-prone, as well as being disadvantageous from the assembly and maintenance standpoints. In addition, the replacement of the inking roller is a time-consuming task and an accurate position between inking roller and transfer roller is not ensured, so that the type is not always uniformly inked independently of ambient conditions.

SUMMARY OF THE INVENTION

An object of the present invention is to provide a printing mechanism in which no part of the inking device projects beyond the leading edge of the casing during the printing process and in which inking rollers are used which, compared with a single inking roller, have the advantage of a large ink volume so as to constantly ensure the uniform inking of the set type. The aim of the invention is an improvement of the printing intensity and an increased number of printable labels before an ink change takes place. When using automatic readers particularly high demands are made on the intensity and uniformity of the print and consequently a larger ink storage volume is required in the case of multiple line printing.

With a printing mechanism according to the invention in the basic position the wedge-shaped space below the printing attachment is utilized by the transfer roller and the ink supply roller. In the printing position the supply and transfer rollers are positioned in front of the printing mechanism, the connecting spindle between the transfer roller and the ink supply roller being pivoted by approximately 90°. This is essentially brought about by sliding on the roller holder, additional components such as torsion springs being unnecessary. Thus, the front face of the apparatus can be kept closed, which also increases protection in case it is dropped.

This general inventive principle can be realised in different constructions. In one printing mechanism according to the invention, the roller holder is pivoted about the transfer roller spindle and has laterally outwardly projecting projections engaging on guide rails arranged on the side walls of the casing.

This printing mechanism according to the invention has the advantage that the supply roller arranged on the roller holder is positioned above the transfer roller during the printing process. Thus, the roller holder does not pivot forwardly beyond the outer contour of the apparatus and instead remains within said contour. It would otherwise be easily possible to damage the supply roller.

Accordingly to a particularly preferred embodiment the transfer roller spindle projects beyond the lateral surfaces of the transfer roller and on either side of the supply roller the roller holder has side walls on which are shaped arms with open bearing orifices, the transfer roller spindle engaging in said orifices. In this particularly preferred embodiment a particularly simple mounting of the roller holder on the transfer roller spindle is ensured. As the roller holder is mounted in open bearing orifices on the transfer roller spindle it can be removed from the latter by mere pulling. During the printing process the inking rocker arm with the transfer roller is swung out to the front, so that the roller holder also mounted on the transfer roller spindle is also displaced to the front. As the lateral projections of the roller holder slide on guide rails the latter, which are positioned on the side walls of the casing, also determine the roller holder movement, so that through the movement of the inking rocker arm and the arrangement of the guide rails the travel of the roller holder during the printing process is determined.

Advantageously in plan view each bearing orifice is circular and the transfer roller spindle is positioned in the circle of the bearing orifice.

Advantageously the projections arranged on the roller holder are constructed as pins with a semicircular cross section which axially project beyond the side walls of the roller holder. The curved side of the semicircle points downwards, so that the pins slide with their cross-sectionally semi-circular underside along the guide rails. This ensures the free sliding of the roller holder, on the guide rails.

Advantageously the slide roller spindle is freely rotatably positioned in slots in the side walls of the roller holder. According to this particularly preferred embodiment the free rotation of the supply roller is ensured.

Advantageously each projection is shaped on to the roller holder side wall approximately level with the slot and the planar surface of each projection is aligned with the lower inner wall of the slot. Advantageously a detent which projects beyond the lower inner wall of the slot is shaped on to each side wall of the roller holder. According to this particularly preferred embodiment the detent which projects beyond the inner wall of the slot prevents the supply roller spindle from sliding out of the slot. However, a slight pressure makes it possible in a simple manner to move out the spindle beyond the detent.

Preferably the bottom of the projections of the roller holder slide on the tops of the guide rails during the printing process and the side walls of the casing are interconnected by means of a spindle on which the bottom of the roller holder engages in the printing position. This ensures that the roller holder is moved upwardly during the swinging out of the inking rocker arm, so that the desired upward movement of the supply roller is ensured.

The inking roller and the transfer roller are preferably made from the same material.

According to a particularly preferred embodiment the roller holder is pivotably mounted on the inking rocker arm, the transfer roller is arranged in freely rotatable manner on the roller holder and the latter has laterally outwardly projecting projections which engage on inwardly projecting projections arranged on the inking rocker arm.

According to a particularly preferred embodiment, arms with open bearing orifices are shaped onto the inking rocker arm and the roller holder has sidewalls onto which are shaped pins engaging the bearing orifices of the inking rocker arm. In this particularly preferred embodiment, a particularly easy mounting of the roller holder on the inking rocker arm is ensured. The pins shaped onto the roller holder engage in the bearing orifices of the inking rocker arm and are carried along with the roller holder on moving said inking rocker arm. As the projection of the roller holder engages on the projections of the inking rocker arm, the downward path of the roller holder is also limited.

Preferably, the pins are constructed as outwardly directed hollow pins, in whose centre is mounted the transfer roller spindle.

Preferably, the projections of the roller holder and inking rocker arm are in the form of shoulders. According to a particularly preferred embodiment, the roller holder projections have planar contact surfaces which are in contact with planar support surfaces of the inking rocker arm projection. According to this embodiment, a particularly easy guidance of the roller holder by the inking rocker arm is ensured. The contacting surfaces of the projections bring about the guidance of the roller holder on moving the inking rocker arm.

The bottom of the roller holder is preferably constructed as a trough which approximately half envelops the transfer roller and the supply roller or only the supply roller. This ensures that the inking rollers cannot be unintentionally touched.

The outside of the trough is preferably provided with partial grooves which, on removing the roller holder from the apparatus prevents the operator's finger from slipping.

The outside of the trough is preferably provided with guide surfaces, which assist the tilting of the roller holder during the printing process.

Preferably, a gripping member is shaped onto the roller holder side adjacent the supply roller. This gripping member makes it possible in a simple manner to remove the roller holder from the apparatus and to optionally replace it by another holder with freshly inked rollers.

Preferably, the sidewalls of the casing are connected by means of a spindle in the vicinity of their leading edges and on which the bottom of the roller holder engages in the printing position. This ensures that on swinging out the inking rocker arm the roller holder is moved upwardly, so that the desired upward movement of the supply roller is ensured.

Preferably, the transfer roller diameter is smaller than the supply roller diameter. In this way, it is possible to utilize the wedge-shaped space below the printing mechanism.

Preferably, a spring is provided in the roller holder which pressurizes the two ends of the supply roller spindle, so that the supply roller comes into contact with the transfer roller. In this embodiment of the printing mechanism according to the invention, the supply roller always engages the transfer roller, so that during the swinging-out movement, the frictional connection between the printing attachment and the two rollers rotate about both the transfer roller and the supply roller, so that further ink passes from the supply roller to the transfer roller.

The invention is described in greater detail hereinafter relative to embodiments and drawings, shown herein:

BRIEF DESCRIPTION OF THE DRAWINGS

FIG. 8 is a side view of the roller holder and part of the inking rocker arm.

FIG. 9 is a sectional view through the roller holder and part of the inking rocker arm.

FIG. 10 is a plan view of the roller holder, supply roller and transfer roller.

FIG. 11 is a perspective view of the inking rocker arm and roller holder with the supply roller and transfer roller.

DESCRIPTION OF THE PREFERRED EMBODIMENTS

Figure 1:
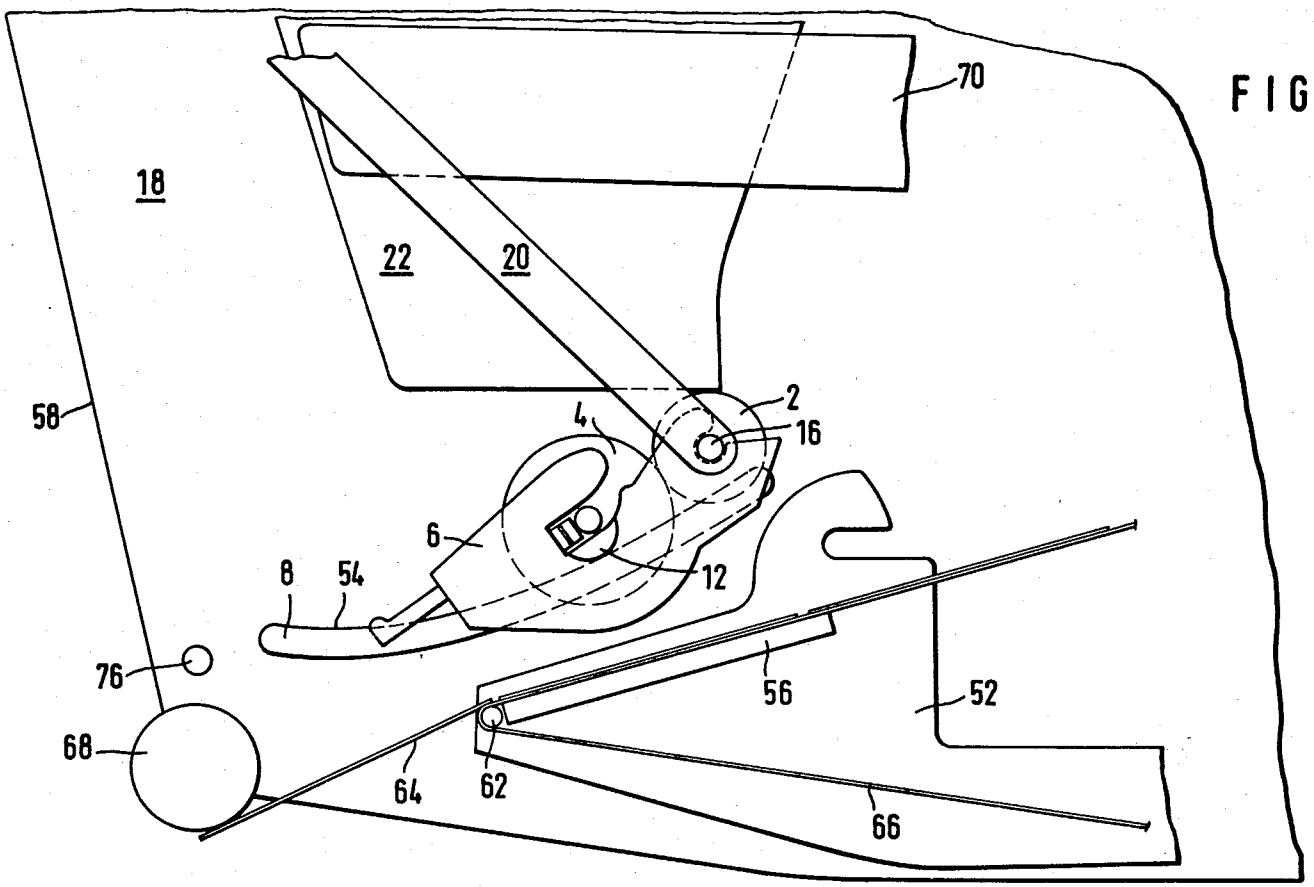
FIG. 1 is a vertical sectional view of part of a labelling device in its initial position.

FIG. 1 shows part of the manually operable labelling device, whose casing contains a printing table 52 with an elastic support 56. At one end of printing table 52 there is a guide edge 62 at which a printed label 64 is detached from a carrying belt 66 guided around the guide edge. Label 64, which is in the dispensing position and whose rear edge adheres to the carrying belt 66 or part of the apparatus has its front edge positioned below a pressure roller 68 by which it is pressed and rolled against an article to be labelled. A printing attachment 22 fixed to a lever 70 pivotably mounted in the labelling device and which can be moved against the printing table 52 is used for printing the labels 64. Lever 70 also brings about the stepwise conveying of the labels 64 on the carrying belt 66.

During each printing process an inking mechanism which inks the set type of the printing attachment with printing ink on is swung out of the path of movement of the printing attachment 22.

Figure 2:
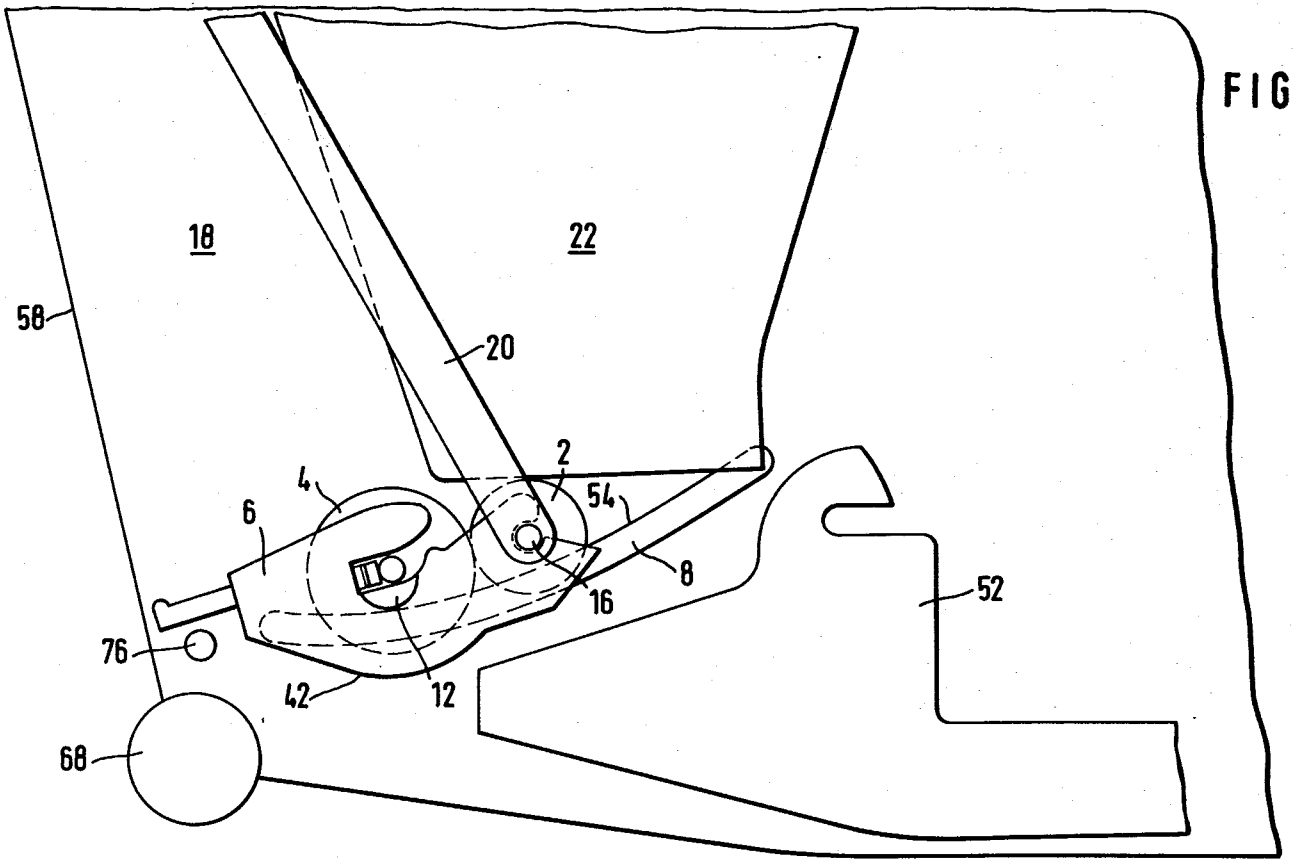
FIG. 2 is a vertical sectional view of part of the labelling device during the swinging out of the inking rocker arm.
Figure 3:
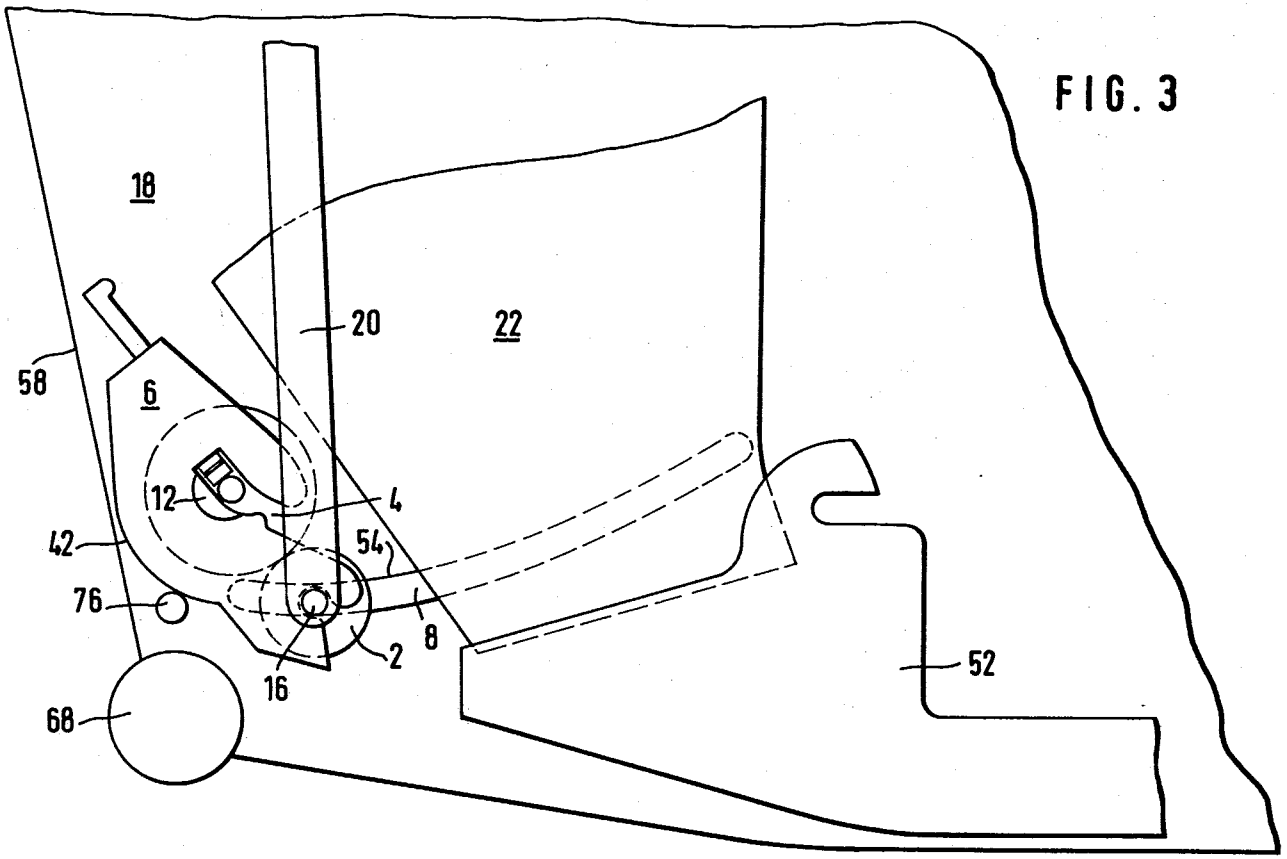
FIG. 3 is a vertical sectional view of part of the labelling device in the printing position.

The inking mechanism comprises an inking rocker arm 20, roller holder 6, a supply roller 4 and a transfer roller 2. Transfer roller 2 is mounted in freely rotatable manner on the end of the inking rocker arm 20 which can be swung out. Supply roller 4 is freely rotatable on roller holder 6. Roller holder 6 is pivoted about the spindle 16 of transfer roller 2 and has outwardly projecting projections 12 and 14, only projection 12 being visible in FIG. 1. The not visible projection 14 is located on guide rail 8 arranged on the sidewall 18 of the casing. Guide rail 8 is curved upwards in the vicinity of the leading edge 58 of casing sidewall 18. There is a guide rail parallel to the indicated guide rail 8 on the not shown casing sidewall. During the printing process the printing attachment 22 is pivoted downwards, whereby the inking mechanism is swung out to the front. FIGS. 2 and 3 show the movement of the inking mechanism during the printing process. During each printing process the transfer roller 2 engaging on the set type and which transfers ink from supply roller 4 to the type is rotated in a clockwise direction and thereby is forced out of the movement path of the printing attachment 22. Without modifying the engagement pressure supply roller 4 is simultaneously swung out and is rotated counter-clockwise by the frictional contact of transfer roller 2, so that ink is supplied to the latter.

In FIG. 2 the inking rocker arm slopes downwardly and the bottom of projection 14 of roller holder 6 slides along the top 54 of guide rail 8. Thus, roller holder 6 with supply roller 4 is pivoted upward about the transfer roller spindle 16. FIG. 3 shows the inking rocker arm 20 in the swung out position in which roller holder 6 has slid to its outermost position on guide rail 8. On comparing FIGS. 1 to 3 it is apparent that the approximately wedge-shaped space utilised by transfer roller 2 and supply roller 4 have been pivoted by approximately 90°. Roller holder 6 does not project beyond the leading edge 58 of the side wall 18 and instead utilizes the free space above the transfer roller.

Figure 4:
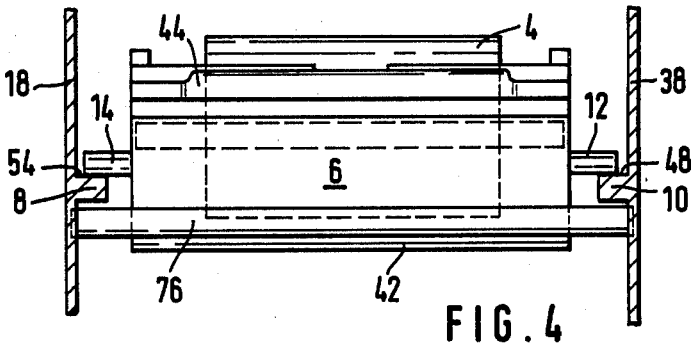
FIG. 4 is a view of part of the labelling device from the front.

In the vicinity of leading edges 58 of side wall 18 a spindle 76 is provided, which interconnects with two side walls 18 and 38 of the casing. The roller holder 6 is shown from the front in FIG. 4. Projection 12 or 14 of roller holder 6 engages on the top 48 or 54 of guide rail 10 or 8. Spindle 76 interconnects side walls 38 and 18. The bottom of roller holder 6 engages on spindle 76 in the printing position. In the embodiment the bottom of roller holder 6 is constructed as a cross 42.

Figure 5:
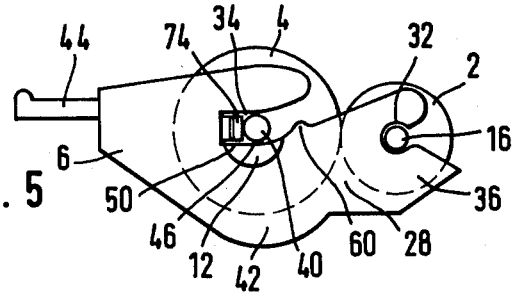
FIG. 5 is a side view of the supply roller, transfer roller and roller holder.
Figure 6:
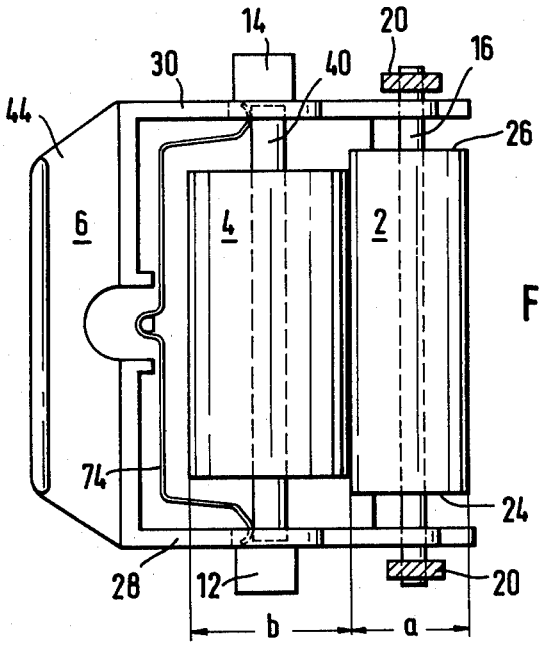
FIG. 6 is a plan view of the roller holder, supply roller and transfer roller.

FIG. 5 is a side view and FIG. 6 a plan view of the roller holder with the two inking rollers.

The spindle 16 of transfer roller 2 projects beyond the lateral surfaces 24 and 26 of transfer roller 2. On either side of supply roller 4, roller holder 6 has side walls 28 and 30, on which are shaped arms 36 and open bearing orifices 32. The transfer roller spindle 16 engages in said bearing orifices. Each bearing orifice is in plan view centrally pitch circular. Thus, roller holder 6 is pivotably mounted about the transfer roller spindle 16. Projections 12 and 14 arranged on roller holder 6 are constructed as pins with a semi-circular cross-section which project axially beyond the side walls 28 and 30 of roller holder 6. A slot 34 is provided in side wall 28 of roller holder 6. There is also a slot on the parallel side wall 30. Spindle 40 of supply roller 4 is freely rotatably arranged in these slots. Projection 12 is shaped on to the side wall 28 of the roller holder approximately level with slot 34 and the planar surface 46 of projection 12 is aligned with the lower inner wall 50 of slot 34. A projection 60 which projects beyond the lower inner wall 50 of slot 34 is shaped on to the side wall 28 of roller holder 6. This makes it difficult for spindle 40 to slide out of slot 34. Spindle 40 can only be drawn out of slot 34 when a certain force is exerted. Side wall 30 of roller holder 6 is constructed in the same way as side wall 28.

The bottom of roller holder 6 forms a trough 42, which approximately embraces half the supply roller 4. A gripping member 44 which prevents the roller holder from being removed from the apparatus is provided on the side of the roller holder 6 adjacent supply roller 4. This permits a rapid and simple replacement of the supply roller with the roller holder. The diameter "a" of transfer roller 2 is smaller than the diameter "b" of supply roller 4. Roller holder 6 contains a spring 74 which pressurises the two ends of spindle 40 of supply roller 4.

Figure 7:
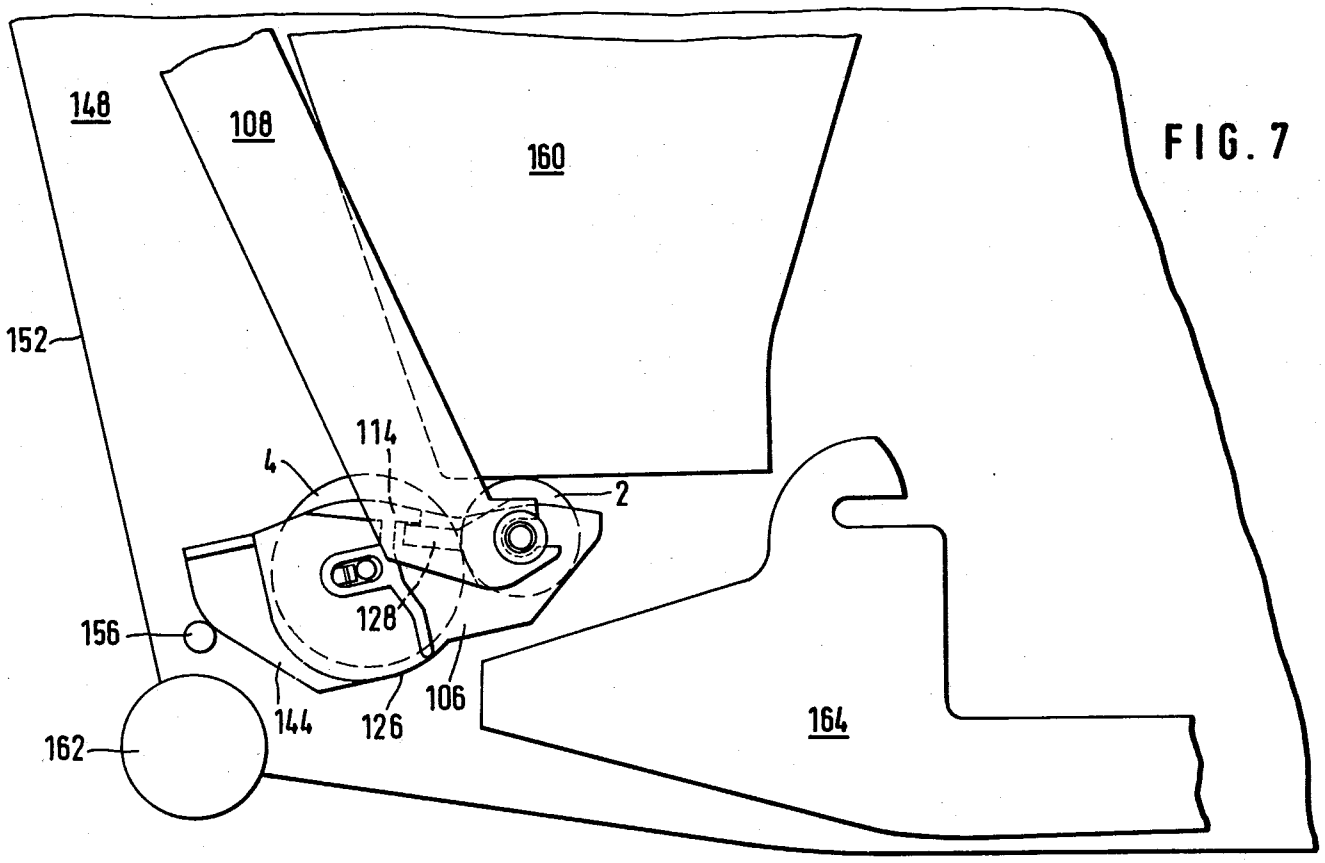
FIG. 7 is a vertical sectional view of part of a labelling device during the swinging-out movement of the inking rocker arm.

FIG. 7 shows part of a manually operated labelling device, in whose casing a printing table 164 is provided. The function of this printing table corresponds to that of printing table 52. A printing device 160 fixed to a pivotably mounted and not shown lever and which can be moved against the printing table 164 is used for printing the labels.

During each printing process, an inking mechanism which inks the set type of the printing attachment with printing ink is swung out of the path of movement of the printing device 160.

The inking mechanism comprises an inking rocker arm 108, a roller holder 106, a supply roller 4 and a transfer roller 2. Both the transfer roller 2 and the supply roller 4 are arranged in freely rotatable manner on the roller holder 106. Roller holder 106 has laterally outwardly projecting projections, 114 and 116, only projection 114 being shown in FIG. 7. Projection 114 engages on an inwardly projecting projection 128 arranged on the inking rocker arm 108. A corresponding projection 130 is provided on the not visible side of the rocker arm. The bottom 126 of roller holder 106 has guide surfaces, only guide surface 144 being visible. Guide surface 144 slides upwards on the spindle 156 together with the roller holder. Spindle 156 connects the sidewalls of the casing in the vicinity of their leading edges. FIG. 7 only shows sidewall 148 and its leading edge 152. By means of pressure roller 162, the labels are pressed against an article to be labelled and rolled on. During the printing process, the printing device 160 pivots downwardly, the inking mechanism being pivoted forwardly. During each printing process, the transfer roller 2 engages on the set type and transfers ink from supply roller 4 to the type is rotated clockwise and forced out of the movement path of printing device 160. Without modifying the contact pressure, supply roller 4 is swung out at the same time and due to the frictional contact of transfer roller 2 is rotated counterclockwise, so that ink is supplied to transfer roller 2.

FIG. 8 shows how the roller holder is arranged on the inking rocker arm. Unlike in FIG. 7, the roller holder is removed from the inking rocker arm and both parts are shown in side view. Inking rocker arm 108 has arm members 132 and 134, whereby only arm member 134 is shown in FIG. 8. Open bearing orifices 136 and 138, whereof orifice 138 is shown in FIG. 8, are shaped onto the arm members. On the not visible side of the inking rocker arm (indicated by dotted lines) is provided the inwardly projecting projection 128 which has the planar support surface 170. Pin 124 which engages in the bearing orifice 138 is located on roller holder 106. Pin 124 is constructed as an outwardly pointing hollow pin and in its centre is mounted the transfer roller spindle. Roller holder 106 has sidewall 120 on which is placed projection 114. On the bottom of projection 114, there is a planar contact surface 166. If pin 124 engages in bearing orifice 138, contact surface 166 of projection 114 engages on the support surface 170 of projection 128. Thus, the movement of roller holder 106 is determined by the movement of the inking rocker arm 108. According to FIG. 8, guide surfaces are provided on the bottom 126 of roller holder 106, guide surface 144 only being visible.

FIG. 9 is a sectional view of the inking rocker arm 108 and roller holder 106. Inking rocker arm 108 has two arm members 134 and 132 on which are arranged inwardly projecting projections 128 and 130. These projections 128 and 130 have planar support surfaces 170 and 172. Projections 114 and 116 of roller holder 106 are positioned above projections 128 and 130 of inking rocker arm 108. These projections have contact surfaces 166 and 168 which are in contact with the support surfaces 170 and 172 of rocker arm 108. Projections 114 and 116 of roller holder 106 project beyond the sidewalls 120 and 118 of roller holder 106. Projections 114 and 116 or 128 and 130 are preferably in the form of shoulders.

Thus, when the inking rocker arm 108 continues to pivot further in a counter-clockwise direction from the FIG. 7 position, the roller holder 160 moves to a position corresponding to that of FIG. 3 in the previously described first embodiment, wherein the roller holder 106 is swung out of the path of movement of the printing attachment 160.

FIG. 10 is a plan view of roller holder 106 with the two inking rollers 4 and 2. The spindle 110 of transfer roller 2 projects beyond the lateral surfaces thereof. Pins 122 and 124 are shaped onto the sidewalls 118 and 120 of roller holder 106 and in the middle of said pins is mounted the spindle 110 of transfer roller 2. Pins 122, 124 are constructed as outwardly projecting hollow pins. Spindle 112 of supply roller 4 is arranged in freely rotatable manner in slots in sidewalls 118, 120. A spring 158 is provided in roller holder 106 which pressurizes the two ends of spindle 112 of supply roller 4. A gripping member 146 is shaped onto the side of roller holder 106 adjacent supply roller 4 and permits the removal of the roller holder from the apparatus. This permits a rapid and simple changing of the roller holder with the rollers. The diameter "a" of transfer roller 2 is smaller than diameter "b" of supply roller 4.

FIG. 11 is a perspective view of inking rocker arm 108 and roller holder 106. Rocker arm 108 has downwardly projecting arm members 132, 134 on which are shaped open bearing orifices 136, 138. Pins 122, 124 of roller holder 106 engage in bearing orifices 136, 138. Only pin 124 is visible in FIG. 11. Roller holder 106 has sidewalls 118, 120. Below gripping member 146, are provided guide surfaces 142, 144 which have outwardly projecting edges. Between the guide surfaces 142, 144 grooves 140 are provided on the bottom 126 of roller holder 106. The bottom 126 of the roller holder is constructed as a trough which approximately envelops half the transfer roller 2 and the supply roller 4.

Roller holder 106 can be removed in simple manner from the inking rocker arm 108 by removing it from the bearing orifices 136, 138. It is then possible to insert a further roller holder with freshly inked rollers 2, 4.

We claim:

1. Printing apparatus for labelling devices and the like comprising a printing means movable between a retracted and a printing position, a roller holder means movable between an operable and a withdrawn position, said roller holder means comprising a holder structure having side walls and mounting a transfer roller and a supply roller, said roller holder means having a first spindle for said transfer roller and a second spindle for said supply roller, said side walls having slot means in which said second spindle is rotatably mounted, said slot means including a lower inner wall, a rocker arm pivotally connected to said roller holder means, said rocker arm being operable to move said roller holder means between said operable and said withdrawn positions as said printing means moves between said retracted to said printing positions, a casing having guide rails disposed adjacent to said roller holder means, and projections on said holder structure adapted to engage said guide rails as said roller holder means is moved from its operable towards its withdrawn position by said rocker arm, said projections being provided on said side walls approximately level with said slot means, said projections having planar surfaces aligned with said lower inner wall of said slot means.

2. Printing apparatus according to claim 1, further comprising detent means projecting from said lower inner wall of said slot means to facilitate retention of said second spindle in said slot means.

3. Printing apparatus for labelling devices and the like comprising a printing means movable between a retracted and a printing position, a roller holder means movable between an operable and a withdrawn position, said roller holder means comprising a holder structure having side walls and mounting a transfer roller and a supply roller, a rocker arm pivotally connected to said roller holder means, said rocker arm being operable to move said roller holder means between said operable and said withdrawn positions as said printing means moves between said retracted to said printing positions, said roller holder means further comprising a spindle for said transfer roller, said spindle having its axis coincident with the pivotal axis about which said roller holder means pivots relative to said rocker arm, a casing having guide rails disposed adjacent said roller holder means, projections on said holder structure adapted to engage and slide on the tops of said guide rails as said roller holder means is moved from its operable towards its withdrawn position by said rocker arm, said roller holder means having means defining an engageable edge, a rod means extending from said casing and disposed within the path of movement of said roller holder means as the latter is moved from its operable towards its withdrawn position, said engageable edge and said rod means being constructed and arranged such that when said rocker arm moves said roller holder means from its operable toward its withdrawn position, said roller holder means is initially slidingly supported on the top of said guide rails by said projections until subsequently said engageable edge engages said rod means so that said rod means lifts the advancing forward portion of said roller holder means and said projections are lifted off of the top of said guide rails, said roller holder means thereby pivoting about said coincident axis.

4. Printing apparatus according to claim 3, wherein said spindle projects beyond the longitudinal ends of said transfer roller, said side walls having arm portions with bearing openings, said spindle being rotatably mounted in said bearing openings.

5. Printing apparatus according to claim 3, wherein said projections are constructed to have a semi-circular cross section which project beyond said side walls.

6. Printing apparatus according to claim 3, wherein said roller holder means further comprises a second spindle for said supply roller, said side walls having slot means in which said second spindle is rotatably mounted.

7. Printing apparatus for labelling devices and the like according to claim 3, wherein said casing comprises two spaced casing walls, said rod means comprising a rod extending between said two spaced casing walls.

8. Printing apparatus for labelling devices and the like according to claim 3, wherein said roller holder means is pivoted approximately 90 degrees by said rod means as said rocker arm moves from its operable to its withdrawn position.

9. Printing apparatus for labelling devices and the like according to claim 3, wherein said engageable edge is located on the edge of said side walls of said holder structure.

10. Printing apparatus for labelling devices and the like comprising a printing means movable between a retracted and a printing position, a roller holder means movable between an operable and a withdrawn position, said roller holder means comprising a holder structure having side walls and mounting a transfer roller and a supply roller, a rocker arm pivotally connected to said roller holder means, said rocker arm being operable to move said roller holder means between said operable and said withdrawn positions as said printing means moves between said retracted to said printing positions, said roller holder means further comprising a spindle for said transfer roller, said spindle having its axis coincident with the pivot axis about which said roller holder means pivots relative to said rocker arm, said roller holder means having first projections and said rocker arm having second projections such that said second projections on said rocker arm engage said first projections on said roller holder means when said roller holder means is in said operable position such that said rocker arm supports said roller holder means in a first angular position relative to said rocker arm, said roller holder means having means defining an engageable edge, a rod means disposed within the path of movement of said roller holder means as the latter is moved from its operable to its withdrawn position, said engageable edge and said rod means being constructed and arranged such that when said rocker arm moves said roller holder means from its operable toward its withdrawn position, said roller holder means is initially supported in said first position until subsequently said engageable edge engages said rod means so that said rod means lifts the advancing forward portion of said roller holder means to thereby pivot said roller holder means about said coincident axis to a second angular position relative to said rocker arm, said second position corresponding to said withdrawn position.

11. Printing apparatus according to claim 10, wherein said first projections project laterally outwardly of said roller holder means and said second projections project laterally inwardly of said rocker arm.

12. Printing apparatus according to claim 10, wherein said first projections have planar surfaces engageable with planar surfaces on said second projections.

13. Printing apparatus according to claim 10, wherein said roller holder means has a bottom constructed as a trough.

14. Printing apparatus according to claim 10 further comprising spring means on said roller holder means providing biasing contact between said transfer roller and said supply roller.

15. Printing apparatus according to claim 10 further comprising a casing disposed adjacent to said roller holder means, said casing comprising two spaced casing walls, said rod means comprising a rod extending between said two spaced casing walls.

16. Printing apparatus according to claim 10, wherein said roller holder means is pivoted approximately 90 degrees by said rod means as said rocker arm moves from its operable to its withdrawn position.

17. Printing apparatus according to claim 10, wherein said engageable edge is located on the edge of said side walls of said holder structures.

18. Printing apparatus according to claim 10, wherein said rocker arm has open bearing means, said side walls having pins thereon, said pins being pivotally received in said open bearing means.

19. Printing apparatus according to claim 18, wherein said transfer roller has a spindle, said pins being hollow and extending outwardly from said side walls, said spindle extending into said hollow pins.

* * * * *